US009044973B2

(12) United States Patent
Takeuchi et al.

(10) Patent No.: US 9,044,973 B2
(45) Date of Patent: Jun. 2, 2015

(54) SHEET CONVEYING APPARATUS AND PRINTING APPARATUS

(75) Inventors: Toshiki Takeuchi, Tokyo (JP); Koichiro Kawaguchi, Yokohama (JP); Shigeru Toriihara, Kawasaki (JP); Kengo Nieda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 185 days.

(21) Appl. No.: 13/371,036

(22) Filed: Feb. 10, 2012

(65) Prior Publication Data

US 2012/0206550 A1 Aug. 16, 2012

(30) Foreign Application Priority Data

Feb. 14, 2011 (JP) ..... 2011-028715

(51) Int. Cl.

| | |
|---|---|
| ***B41J 2/01*** | (2006.01) |
| ***B41J 29/38*** | (2006.01) |
| ***B41J 13/02*** | (2006.01) |
| ***B41J 13/00*** | (2006.01) |
| ***B41J 11/00*** | (2006.01) |
| ***B65H 5/06*** | (2006.01) |
| ***B65H 20/02*** | (2006.01) |

(52) U.S. Cl.

CPC ..... *B41J 13/025* (2013.01); *B41J 13/02* (2013.01); *B41J 13/0009* (2013.01); *B41J 11/003* (2013.01); *B65H 5/062* (2013.01); *B65H 20/02* (2013.01); *B65H 2403/514* (2013.01); *B65H 2403/52* (2013.01); *B65H 2404/143* (2013.01); *B65H 2404/1441* (2013.01); *B65H 2511/416* (2013.01); *B65H 2515/312* (2013.01); *B65H 2515/34* (2013.01); *B65H 2701/1719* (2013.01); *B65H 2801/09* (2013.01); *B65H 2801/15* (2013.01)

(58) Field of Classification Search

None

See application file for complete search history.

(56) References Cited

U.S. PATENT DOCUMENTS

| | | | | | |
|---|---|---|---|---|---|
| 2,297,490 | A | * | 9/1942 | Martin et al. | 400/637.5 |
| 4,419,003 | A | * | 12/1983 | Fujie et al. | 399/322 |
| 4,426,073 | A | * | 1/1984 | Mizuma | 271/251 |
| 4,878,772 | A | * | 11/1989 | Fukumoto et al. | 400/636.3 |
| 4,953,846 | A | * | 9/1990 | Azeta et al. | 271/251 |
| 5,000,439 | A | * | 3/1991 | Yoshizawa | 271/274 |
| 5,038,155 | A | * | 8/1991 | Yamagishi et al. | 347/198 |
| 5,062,726 | A | * | 11/1991 | Inomata et al. | 400/630 |
| 5,239,904 | A | * | 8/1993 | Yamaguchi et al. | 83/210 |
| 5,485,991 | A | * | 1/1996 | Hirano et al. | 271/121 |
| 5,540,427 | A | * | 7/1996 | Nitta et al. | 271/274 |
| 5,594,486 | A | * | 1/1997 | Kiyohara | 347/104 |

(Continued)

FOREIGN PATENT DOCUMENTS

| | | | | |
|---|---|---|---|---|
| JP | 02030569 | A | * | 1/1990 |
| JP | 11-208923 | A | | 8/1999 |

(Continued)

*Primary Examiner* — Julian Huffman
*Assistant Examiner* — Leonard S Liang
(74) *Attorney, Agent, or Firm* — Canon USA Inc IP Division

(57) ABSTRACT

A sheet conveying apparatus coveys a sheet while nipping the sheet between a conveyance roller and a pinch roller. The pinch roller includes a first roller portion and a second roller portion adjacent to each other in a rotational axial direction thereof. The pinch roller further includes a mechanism configured to change a difference between a pressing force that the first roller portion applies to the conveyance roller and a pressing force that the second roller portion applies to the conveyance roller.

10 Claims, 11 Drawing Sheets

(56) References Cited

U.S. PATENT DOCUMENTS

| | | | | |
|---|---|---|---|---|
| 5,734,404 | A * | 3/1998 | Komuro et al. | 347/104 |
| 5,988,635 | A * | 11/1999 | Ohshima | 271/274 |
| 6,170,727 | B1 * | 1/2001 | Hevenor et al. | 226/21 |
| 6,279,900 | B1 * | 8/2001 | Yamagishi | 271/240 |
| 6,682,069 | B2 * | 1/2004 | Shibabuki | 271/274 |
| 7,451,974 | B2 * | 11/2008 | Niizeki | 271/109 |
| 7,758,044 | B2 * | 7/2010 | Nonaka | 271/274 |
| 7,900,919 | B2 * | 3/2011 | Ledgerwood et al. | 271/274 |
| 8,177,229 | B2 * | 5/2012 | Ledgerwood et al. | 271/271 |
| 8,215,638 | B2 * | 7/2012 | Nieda et al. | 271/240 |
| 8,849,179 | B2 * | 9/2014 | Sahara | 399/400 |
| 2002/0130463 | A1 * | 9/2002 | Michel | 271/274 |
| 2004/0178571 | A1 * | 9/2004 | Ohama et al. | 271/272 |
| 2005/0184455 | A1 * | 8/2005 | Youn | 271/274 |
| 2005/0206074 | A1 * | 9/2005 | Tsuzawa | 271/270 |
| 2006/0250468 | A1 * | 11/2006 | Nakamura | 347/104 |
| 2008/0143765 | A1 * | 6/2008 | Takahashi et al. | 347/8 |
| 2010/0310280 | A1 * | 12/2010 | Kondo et al. | 399/297 |
| 2012/0118186 | A1 * | 5/2012 | Nishiyama et al. | 101/248 |

FOREIGN PATENT DOCUMENTS

| | | |
|---|---|---|
| JP | 2005-041618 A | 2/2005 |
| JP | 2006-036435 A | 2/2006 |

* cited by examiner (NIP STATE)

(RELEASE STATE)

FIG. 8

| | PINCH ROLLER 102a | PINCH ROLLER 102b | PINCH ROLLER 102c | PINCH ROLLER 102d |
|---|---|---|---|---|
| PRIMARY SPRING | a (600gf) | b (500gf) | b (500gf) | a (600gf) |
| AUXILIARY SPRING | c (200gf) | d (500gf) | d (500gf) | c (200gf) |
| TOTAL PRESSURE | a+2c(1000gf) | b+2d(1500gf) | b+2d(1500gf) | a+2c(1000gf) |

FIG. 9

| | PINCH ROLLER 102a | PINCH ROLLER 102b | PINCH ROLLER 102c | PINCH ROLLER 102d | TOTAL PRESSURE |
|---|---|---|---|---|---|
| EXAMPLE 1 | 1500gf | 1500gf | 1500gf | 1500gf | 6000gf |
| EXAMPLE 2 | 1000gf | 1500gf | 1500gf | 1000gf | 5000gf |
| EXAMPLE 3 | 200gf | 1000gf | 1000gf | 200gf | 2400gf |
| EXAMPLE 4 | RELEASE | 1500gf | 1500gf | RELEASE | 3000gf |
| EXAMPLE 5 | RELEASE | RELEASE | RELEASE | RELEASE | 0gf |

SHEET CONVEYING APPARATUS AND PRINTING APPARATUS

BACKGROUND OF THE INVENTION

1. Field of the Invention

The present invention relates to a technique for a sheet conveying apparatus usable with a printing apparatus.

2. Description of the Related Art

Japanese Patent Application Laid-Open No. 11-208923 discusses a printing apparatus that conveys a sheet by using a conveying mechanism including rollers. A sheet is nipped by a roller pair constituted by a conveyance roller and a driven roller, and is conveyed according to a rotation of the roller pair. The driven roller is divided into a plurality (three) of small rollers along the direction of the rotational axis thereof. The plurality of divided rollers is collectively pressed by using a single pressing unit, and the nip pressures thereof are changed as the sheet is transported forward.

The printing apparatus discussed in Japanese Patent Application Laid-Open No. 11-208923 is configured in such a manner that forces provided to change the nip pressures act on the plurality of divided driven rollers in a uniform way for all of them, and these forces cannot be adjusted individually.

SUMMARY OF THE INVENTION

One aspect of the present invention is directed to a sheet conveying apparatus and a printing apparatus capable of conveying a sheet at high accuracy regardless of a sheet that the printing apparatus uses.

According to an aspect of the present invention, a sheet conveying apparatus includes a conveyance roller, and a pinch roller configured to nip a sheet between the conveyance roller and the pinch roller. The pinch roller includes a first roller portion and a second roller portion adjacent to each other in a rotational axial direction thereof, and further includes a mechanism configured to change a difference between a pressing force that the first roller portion applies to the conveyance roller and a pressing force that the second roller portion applies to the conveyance roller.

According to an exemplary embodiment of the present invention, the difference between the respective pressing forces of the first roller portion and the second roller portion included in the pinch roller can be changed, so that a sheet conveying apparatus and a printing apparatus capable of conveying a sheet at high accuracy regardless of a sheet that the printing apparatus uses can be implemented.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 8 illustrates an example of set values of the nip pressures of the pinch rollers.

FIG. 9 illustrates examples of set values of the nip pressures of the pinch rollers according to sheets.

DESCRIPTION OF THE EMBODIMENTS

Various exemplary embodiments, features, and aspects of the invention will be described in detail below with reference to the drawings.

A printing apparatus based on the inkjet printing method according to an exemplary embodiment of the present invention is a high-speed line printer using a long continuous sheet (a continuous sheet longer than a repeated print unit referred to as "one page" or "unit image" in a conveyance direction) and capable of performing both one-sided printing and two-sided printing. For example, this printing apparatus is suitable to the field of printing of a large number of sheets, for example, in a print lab.

The present exemplary embodiment can be widely applied to a printing apparatus that uses ink and has to dry the ink thereafter, such as a printer, a multifunction peripheral, a copying machine, a facsimile apparatus, and manufacturing apparatuses of various kinds of devices. Further, the present exemplary embodiment can be also applied to a printing apparatus that forms a latent image on a sheet coated with a photosensitive material by, for example, a laser, and performs printing by the liquid development method. Further, the present exemplary embodiment can be also applied to not only a sheet processing apparatus that performs printing processing, but also sheet processing apparatuses that perform various kinds of processing (for example, recording, processing, coating, irradiating, reading, and inspecting) on a sheet.

Figure 1:
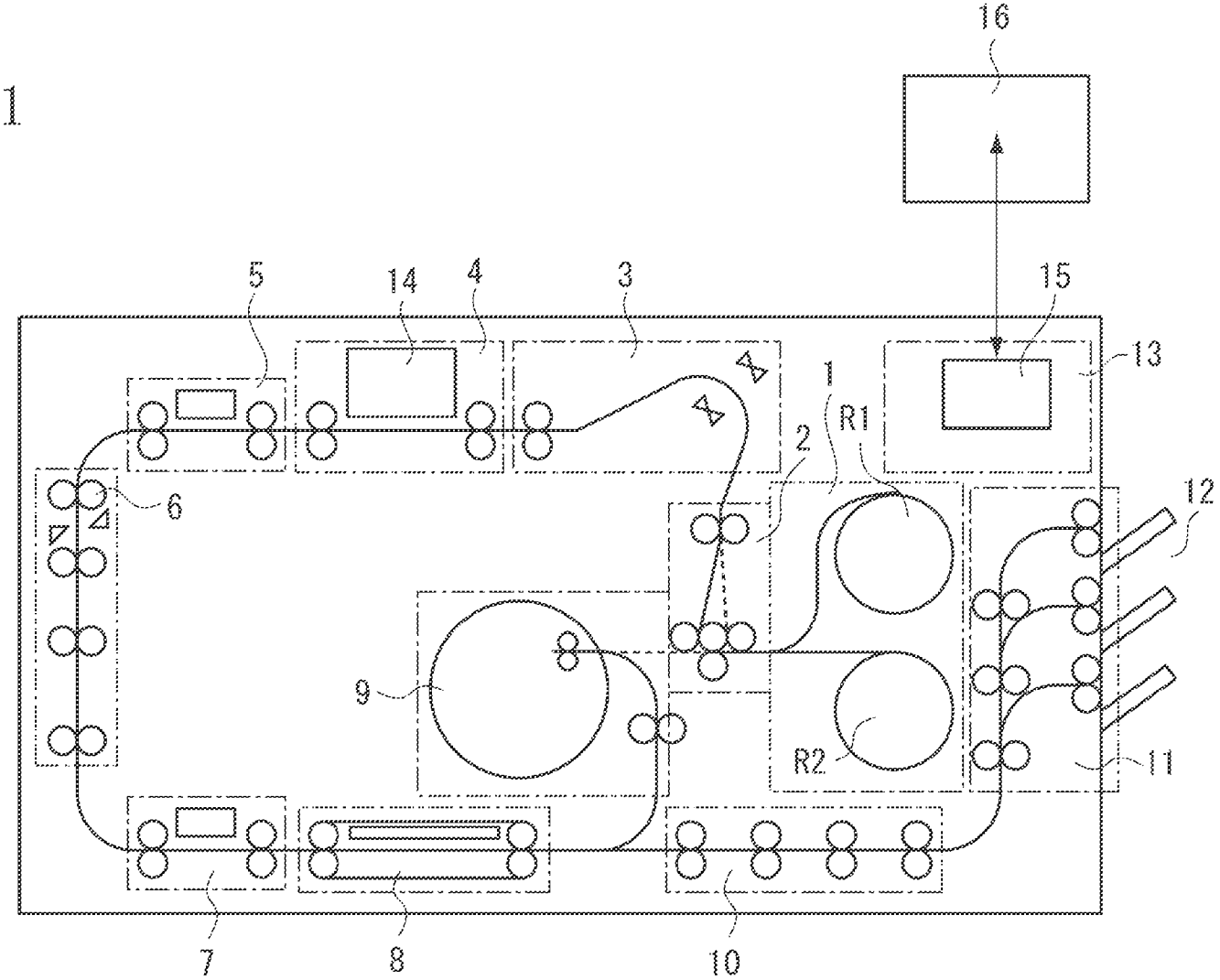
FIG. 1 schematically illustrates a configuration of a printing apparatus according to an exemplary embodiment of the present invention.

FIG. 1 is a cross-sectional view schematically illustrating the internal configuration of the printing apparatus according to the present exemplary embodiment. The printing apparatus according to the present exemplary embodiment uses a sheet wound into a rolled shape, and can perform two-sided printing on a first surface of the sheet and a second surface of the sheet, which is the back surface side of the first surface. As the internal configuration, the printing apparatus generally includes a sheet feeding unit 1, a decurling unit 2, a skew correction unit 3, a printing unit 4, an inspection unit 5, a cutter unit 6, an information recording unit 7, a drying unit 8, a reversing unit 9, a discharge conveyance unit 10, a sorter unit 11, a sheet discharge unit 12, and a control unit 13. The sheet discharge unit 12 is a unit including the sorter unit 11 and in charge of sheet discharge processing. A sheet is conveyed along a sheet conveyance path indicated by the solid line in FIG. 1 by a conveying mechanism including roller pairs and belts, and undergoes processing at the respective units. The terms "upstream" and "downstream" will be used herein to describe an arbitrary position along the sheet conveyance path from a position where a sheet is fed to a position where the sheet is discharged, in such a manner that a position closer to the sheet feeding unit 1 is referred to as "upstream" and a position farther away from the sheet feeding unit 1 is referred to as "downstream".

The sheet feeding unit 1 is a unit for holding and feeding a continuous sheet wound into a rolled shape. The sheet feeding unit 1 can contain two rolls R1 and R2, and is configured to selectively pull out one of them to feed it. The number of rolls that the sheet feeding unit 1 can contain is not limited to two, and the sheet feeding unit 1 can contain less than or greater than two rolls. Further, the present exemplary embodiment may use any continuous sheet which is not limited to a sheet wound into a rolled shape. For example, the present exemplary embodiment may use a continuous sheet which is perforated at each unit length and folded at each line of the perforation, and is then stacked in this state to be contained in the sheet feeding unit 1.

The decurling unit 2 is a unit for reducing a curl (warpage) of a sheet fed from the sheet feeding unit 1. The decurling unit 2 conveys a sheet while curving the sheet so as to provide a warpage in the opposite direction from a curl with use of two pinch rollers for one conveyance roller to thereby exert a decurling force to reduce the curl.

The skew correction unit 3 is a unit for correcting a skew state (inclination relative to an originally set forward direction) of a sheet transported from the decurling unit 2. The skew correction unit 3 corrects a skew state of a sheet by pressing the sheet edge of the side that is used as a basis of the correction against a guide member. A loop is formed at the sheet being conveyed at the skew correction unit 3.

The printing unit 4 is a sheet processing unit for forming an image by applying print processing onto a sheet being conveyed from above the sheet by print heads 14. In other words, the printing unit 4 is a processing unit for performing predetermined processing on a sheet. The printing unit 4 also includes a plurality of conveyance rollers for conveying a sheet. As the print heads 14, a plurality of print heads is arranged in parallel with one another along the conveyance direction. In the present exemplary embodiment, the printing apparatus includes seven line print heads corresponding to seven colors of cyan (C), magenta (M), yellow (Y), light cyan (LC), light magenta (LM), gray (G), and black (K). The number of colors and the number of print heads are not limited to seven. Further, as the inkjet printing method, the printing apparatus according to the present exemplary embodiment may employ, for example, the method using a heating element, a piezoelectric element, an electrostatic element, and a micro electric mechanical systems (MEMS) element. Ink of each color is supplied from an ink tank to the print head 14 through a corresponding ink tube.

The inspection unit 5 is a unit for optically reading an inspection example or image, which is printed onto a sheet at the printing unit 4, by a scanner to inspect, for example, a nozzle state of the print heads 14, a sheet conveyance state, and an image position, thereby determining whether an image is correctly printed. The scanner includes a charge coupled device (CCD) image sensor or a complementary metal-oxide semiconductor (CMOS) image sensor.

The cutter unit 6 is a unit including a cutter for cutting a printed sheet into pieces each having a predetermined length. The cutter cuts a sheet at a margin area between images formed on the sheet and at the rear of an image printed last.

The information recording unit 7 is a unit for recording print information (unique information) such as a serial number and/or a print date of a print output on an unprinted area of a cut sheet. This recording is performed by printing a character and a code by, for example, the inkjet printing method or the thermal transfer method.

The drying unit 8 is a unit for heating a sheet printed at the printing unit 4 to dry the provided ink in a short time. In the drying unit 8, hot air is applied to at least the bottom surface of a sheet passing through, thereby drying the surface with ink provided thereon. The drying method here is not limited to applying hot air. The drying unit 8 may dry a sheet surface by emitting electromagnetic waves (for example, ultraviolet ray or infrared ray) onto the sheet surface.

The sheet conveyance path from the sheet feeding unit 1 to the drying unit 8 described above is referred to as a "first path". The first path is shaped to have a U-turn between the printing unit 4 and the drying unit 8, and the cutter unit 6 is located at some position along the U-turn shape.

The reversing unit 9 is a unit for temporarily taking up a continuous sheet with an image printed on the front surface thereof to turn over the sheet during two-sided printing. The reversing unit 9 is disposed at some position along a path (loop path referred to as a "second path") from the drying unit 8 to the printing unit 4 via the decurling unit 2 so as to supply a sheet transferred from the drying unit 8 to the printing unit 4 again. The reversing unit 9 includes a take-up rotator (drum) configured to rotate to take up a sheet. An uncut continuous sheet, after printing of the front surface, is temporarily taken up by the take-up rotator. After the take-up is finished, the take-up rotator is rotated in the reverse direction so that the taken up sheet is sent in reverse order of the order at the time of the take-up to be supplied to the decurling unit 2, and is then sent to the printing unit 4. Since this sheet is turned upside down, the printing unit 4 can print an image on the back surface of the sheet. Assuming that the sheet feeding unit 1 is a first sheet feeding unit, the reversing unit 9 can be considered as a second sheet feeding unit. More specific details of the two-sided printing operation will be described below.

The discharge conveyance unit 10 is a unit for conveying a sheet cut by the cutter unit 6 and dried by the drying unit 8 to transfer the sheet to the sorter unit 11. The discharge conveyance unit 10 is disposed at a path (referred to as a "third path") different from the second path where the reversing unit 9 is disposed. A path switching mechanism having a movable flapper is disposed at a path branching position (referred to as a "discharge branching position") so as to selectively guide a sheet conveyed along the first path to any one of the second path and the third path.

The sheet discharge unit 12 including the sorter unit 11 is disposed at a position at the side of the sheet feeding unit 1 and at the terminal of the third path. The sorter unit 11 is a unit for sorting printed sheets into groups as necessary. The sorted sheets are discharged onto a plurality of trays included in the sheet discharge unit 12. In this way, the third path is laid out so as to extend below the sheet feeding unit 1 to discharge a sheet to the opposite side of the sheet feeding unit 1 from the printing unit 4 and the drying unit 8.

In this way, the units from the sheet feeding unit 1 to the drying unit 8 are disposed along the first path in this order. The path beyond the drying unit 8 is branched into the second path and the third path. The second path includes the reversing unit 9 at a position along it, and is merged with the first path at a position beyond the reversing unit 9. The third path includes the sheet discharge unit 12 at the terminal thereof.

The control unit 13 is a unit in charge of control of the respective units of the entire printing apparatus. The control unit 13 includes a central processing unit (CPU), a storage device, a controller (control unit) including various kinds of control units, an external interface, and an operation unit 15 where a user provides an input and receives an output. The operation of the printing apparatus is controlled based on an instruction from the controller or a host apparatus 16 such as a host computer connected to the controller via the external interface.

Figure 2:
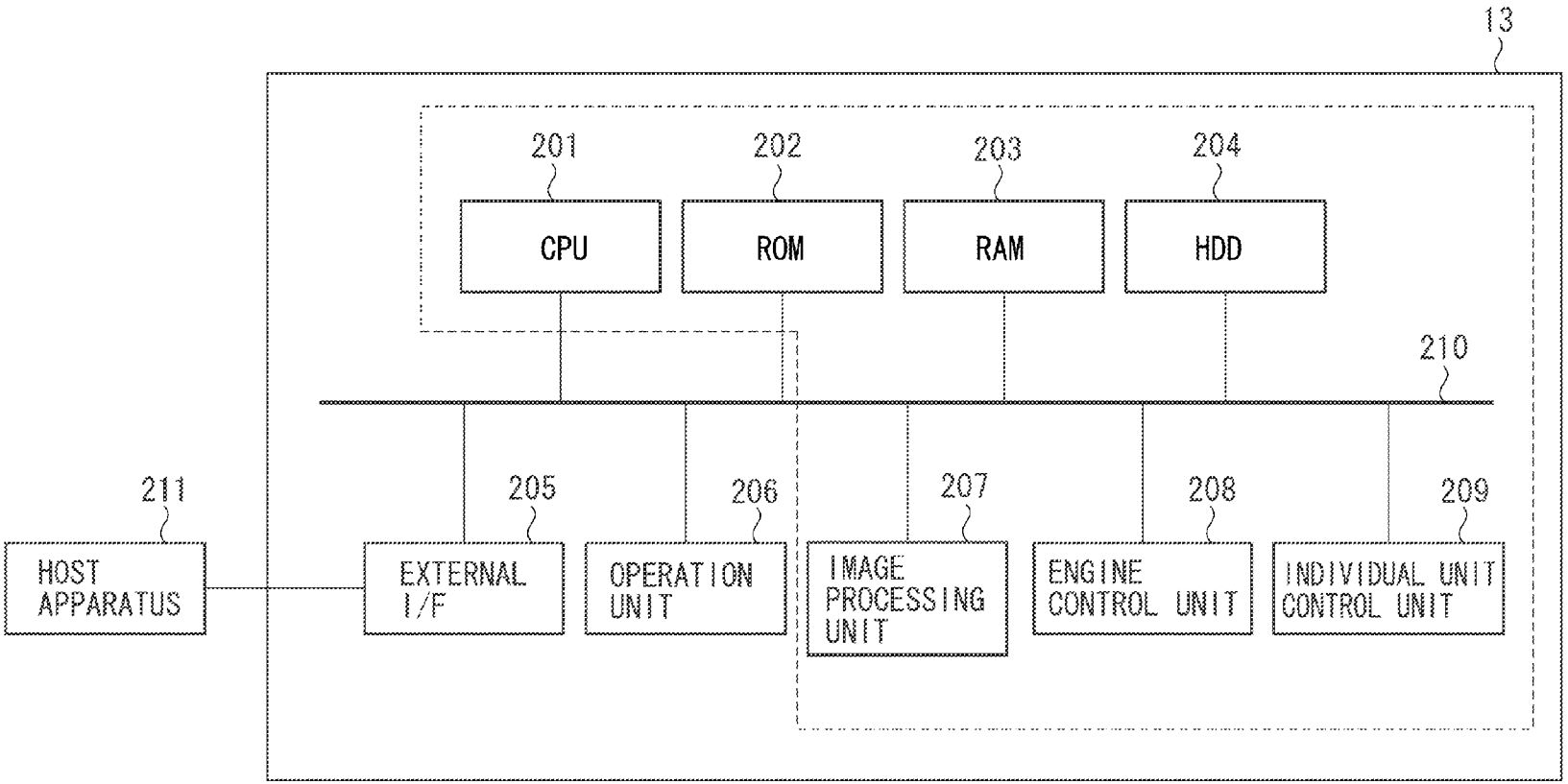
FIG. 2 is a block diagram of a control unit according to the exemplary embodiment of the present invention.

FIG. 2 is a block diagram illustrating the configuration of the control unit 13. The controller (the range surrounded by the broken line) included in the control unit 13 is constituted by a central processing unit (CPU) 201, a read only memory (ROM) 202, a random access memory (RAM) 203, a hard disk drive (HDD) 204, an image processing unit 207, an engine control unit 208, and an individual unit control unit 209. The CPU 201 centrally controls the operations of the respective units of the printing apparatus. The ROM 202 stores programs to be executed by the CPU 201, and fixed data required for various kinds of operations of the printing apparatus. The RAM 203 is used as a work area for the CPU 201, a temporary storage area of various kinds of received data, and an area for storing various kinds of setting data. The HDD 204 can store programs to be executed by the CPU 201, print data, and setting information required for various kinds of operations of the printing apparatus, and allows those data pieces to be read out from the HDD 204. An operation unit 206 is an input/output interface with a user, and includes an input unit such as hard keys and a touch panel, and an output unit such as a display, which shows information, and an audio generator.

A dedicated processing unit is provided to a unit that is required to perform data processing at a high speed. The image processing unit 207 applies image processing to print data handled by the printing apparatus. The image processing unit 207 converts the color space (for example, Luminance/Chroma Blue/Chroma Red (YCbCr)) of input image data into a commonly-used Red/Green/Blue (RGB) color space (for example, the standard RGB (sRGB) color space). Further, the image processing unit 207 applies various kinds of image processing such as a resolution conversion, an image analysis, and an image correction to image data as necessary. The print data acquired by these kinds of image processing is stored in the RAM 203 or the HDD 204. The engine control unit 208 drives and controls the print heads 14 of the printing unit 4 according to print data based on a control command received from, for example, the CPU 201. Further, the engine control unit 208 also controls the conveying mechanisms of the respective units in the printing apparatus. The individual unit control unit 209 is a sub controller for individually controlling the respective units of the sheet feeding unit 1, the decurling unit 2, the skew correction unit 3, the inspection unit 5, the cutter unit 6, the information recording unit 7, the drying unit 8, the reversing unit 9, the discharge conveyance unit 10, the sorter unit 11, and the sheet discharge unit 12. The individual control unit 209 controls the operations of the respective units based on an instruction from the CPU 201. The external interface 205 is an interface (I/F) for enabling a connection of the controller to a host apparatus 211, and is a local I/F or a network I/F. The constituent elements mentioned above are connected to one another through a system bus 210.

The host apparatus 16 is an apparatus that serves as a supply source of image data that the printing apparatus is ordered to print. The host apparatus 16 may be either a general-purpose computer or a dedicated computer. Alternatively, the host apparatus 16 may be a dedicated image device such as an image capture device including an image reader unit, a digital camera, and a photo storage medium. In a case where the host apparatus 16 is a computer, an operating system (OS), application software for generating image data, and a printer driver for the printing apparatus are installed in a storage apparatus of the computer.

Next, a basic operation performed during printing will be described. The printing apparatus operates in different manners in the one-sided printing mode and the two-sided printing mode, and, therefore, both the one-sided printing mode and the two-sided printing mode will be described, respectively.

First, the one-sided printing mode will be described. The thick solid line in FIG. 1 indicates the conveyance path from a supply of a sheet from the sheet feeding unit 1 to a discharge of the sheet to the sheet discharge unit 12 after printing of the sheet. The sheet feeding unit 1 supplies a sheet, and the decurling unit 2 and the skew correction unit 3 apply respective processing to the sheet. Then, the printing unit 4 prints an image onto the front surface (first surface) of the sheet. The printing unit 4 sequentially prints images (unit images), each of which has a predetermined unit length in the conveyance direction, on the long continuous sheet, and forms a plurality of images while lining up them. After that, the inspection unit 5 inspects the printed sheet, and the cutter unit 6 cuts the printed sheet for each unit image. The information recording unit 7 records the print information onto the back surfaces of the divided cut sheets, when necessary. Then, the cut sheets are conveyed to the drying unit 8 one-by-one to be dried there. After that, the sheets are sequentially discharged and stacked on the sheet discharge unit 12 of the sorter unit 11 through the discharge conveyance unit 10. The sheet left at the printing unit 4 after the cutting of the last unit image is transported back to the sheet feeding unit 1, and is wound up around the roll R1 or R2. As will be described below, when the remaining portion of the continuous sheet is transported back in this way, the decurling unit 2 is adjusted to have a reduced decurling force, and the print heads 14 are controlled to be retracted from the sheet. In this way, in the one-sided printing mode, a sheet is processed while being transported through the first and third paths, but is not transported through the second path.

Next, the two-sided printing mode will be described. The printing apparatus executes a front (first)-surface print sequence, and consecutively executes a back (second)-surface print sequence. In the front-surface print sequence performed first, the respective units from the sheet feeding unit 1 to the inspection unit 5 operate in the same manner as the operations for the above-described one-sided printing. The cutter unit 6 does not cut the sheet at this time, and, therefore, the sheet is conveyed to the drying unit 8 as a continuous sheet. After the ink on the surface is dried at the drying unit 8, the sheet is guided to the path (second path) leading to the reversing unit 9, not to the path (third path) leading to the discharge conveyance unit 10. In the second path, the sheet is taken up by the take-up drum of the reversing unit 9, which rotates in the forward direction (the counterclockwise direction as viewed in FIG. 1). After the printing unit 4 completes printing all of data supposed to be printed onto the front surface, the cutter unit 6 cuts the continuous sheet at the trailing edge of the printed area of the continuous sheet. Based on this cut position, the portion (printed portion) of the continuous sheet at the downstream side in the conveyance direction is transported through the drying unit 8, and is all taken up at the reversing unit 9 until even the trailing edge (the cut position) of the portion is wound around the take-up drum. On the other hand, at the same as the take-up of the reversing unit 9, the portion of the continuous sheet left at the upstream side (the side including the printing unit 4) relative to the cut position in the conveyance direction is returned to the sheet feeding unit 1 and is wound around the roll R1 or R2 so as to prevent even the leading edge of the sheet (the cut position) from remaining at the decurling unit 2. This returning of the remaining sheet (feedback) prevents the sheet from bumping into the sheet supplied again during the back-surface printing sequence, which will be described below. As will be described below, during this returning of the remaining sheet, the decurling unit 2 is adjusted to have a reduced decurling force, and the print heads 14 are controlled to be retracted from the sheet.

After the above-described front-surface printing sequence, the operation is switched to the back-surface printing sequence. The take-up drum of the reversing unit 9 starts to rotate in the opposite direction (the clockwise direction as viewed in FIG. 1) from the direction at the time of taking up the sheet. The edge of the wound sheet (the trailing end of the sheet when the sheet is taken up becomes the leading edge of the sheet when the sheet is sent out) is sent into the decurling unit 2 along the path indicated by the broken line in FIG. 1. The decurling unit 2 corrects a curl added at the take-up rotator. In other words, the decurling unit 2 is located between the sheet feeding unit 1 and the printing unit 4 in the first path, and is also located between the reversing unit 9 and the printing unit 4 in the second path, so as to serve as a common unit for providing the decurling function in both paths. The sheet, which is turned upside down, is transported to the printing unit 4 through the skew correction unit 3, and then the printing unit 4 prints an image onto the back surface of the sheet. After that, the printed sheet is transported to the cutter unit 6 through the inspection unit 5, and then the cutter unit 6 cuts the printed sheet per predetermined unit length which is set in advance. Since the cut sheets each have images printed on both the front surface and the back surface, the information recording unit 7 does not record any information onto the sheets at this time. The cut sheets are conveyed to the drying unit 8 one by one, and are sequentially discharged and stacked onto the sheet discharge unit 12 of the sorter unit 11 through the discharge conveyance unit 10. In this way, in the two-sided printing mode, the sheet is processed while being transported through the first path, the second path, the first path, and the third path in this order.

Figure 3:
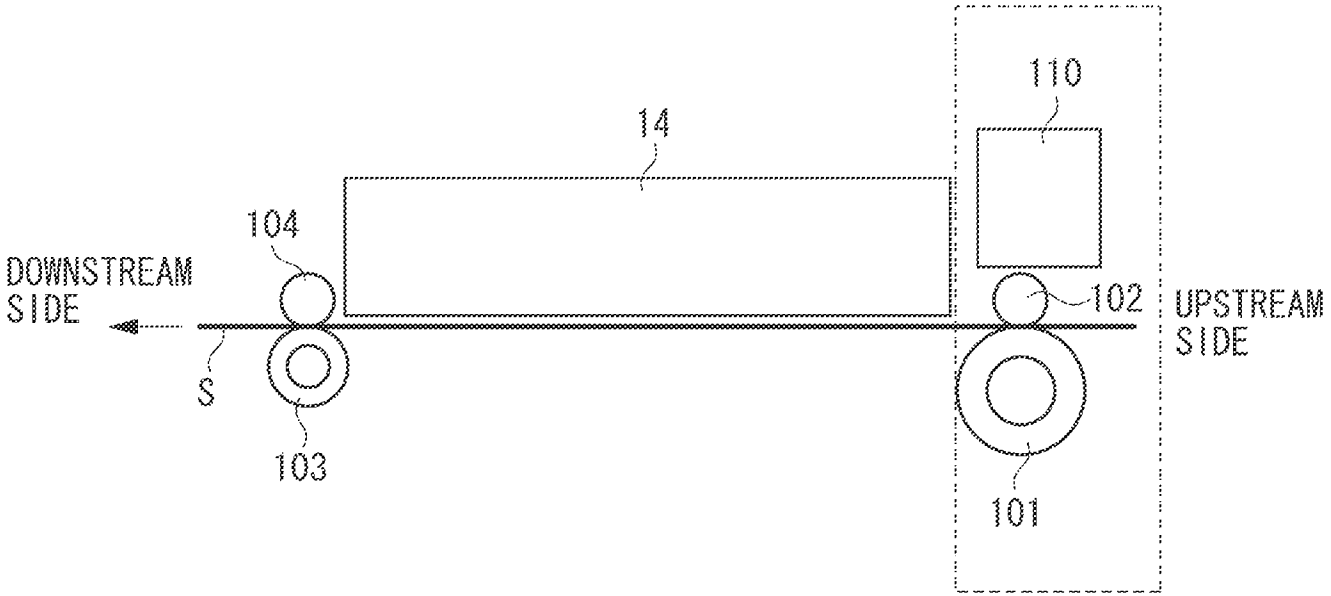
FIG. 3 is a cross-sectional view illustrating the positional relationship among a print head of a printing unit and roller pairs.

FIG. 3 is a cross-sectional view illustrating the positional relationship among the print head 14 of the printing unit 4 and two roller pairs located upstream and downstream. A first roller pair and a second roller pair are respectively disposed at the upstream side and the downstream side of the print head 14 in such a direction (the direction indicated by the arrow) that a sheet S is conveyed while being printed. The sheet S is conveyed at the printing unit 4 by these roller pairs.

The first roller pair includes a conveyance roller 101 provided with a rotation driving force, and a pinch roller 102 driven to rotate. Further, an adjustment mechanism 110 is provided so as to individually variably adjust a nip pressure which the pinch roller 102 applies to the conveyance roller 101. The second roller pair includes a conveyance roller 103 provided with a rotation driving force, and a pinch roller 104 driven to rotate. The conveyance forces with which the first roller pair and the second roller pair convey a sheet are set so as to satisfy the relationship expressed by the following mathematical expression (1).

$$\text{first roller pair} > \text{second roller pair} \quad (1)$$

The conveyance force of a roller pair is determined based on the nip pressure of the pinch roller. This is because, as a nip pressure is increased, this increase makes it difficult to generate a slip between a sheet and the surface of the roller. A nip pressure is determined based on the spring pressure of a spring that presses a pinch roller against a conveyance roller. When this relationship is satisfied, the first roller pair has maximum dominance over the sheet conveyance accuracy.

The conveyance speeds of the respective roller pairs (the circumferential speeds of the conveyance rollers 101 and 103) are set so as to satisfy the relationship expressed by the following mathematical expression (2).

$$\text{second roller pair} > \text{first roller pair} \quad (2)$$

According to the relationship between the conveyance forces (mathematical expression (1)) and the relationship between the conveyance speeds (mathematical expression (2)), almost no slip is generated at the nip position of the first roller pair (between the conveyance roller 101 and the sheet S), which is a main conveyance unit. On the other hand, a slip is generated at the nip position of the second roller pair (between the conveyance roller 103 and the sheet S) due to a difference between the speeds.

In the configuration satisfying the above-described relationships, the first roller pair controls the conveyance accuracy as a whole of the printing unit 4. Between the first roller pair and the second roller pair, the sheet S is conveyed while being pulled toward the downstream side by the second roller pair operating at a higher conveyance speed. Therefore, a tension is applied to the sheet S to prevent the sheet S from locally floating, whereby a constant distance is kept between the print head 14 and the sheet S to maintain the high printing accuracy.

The pinch roller 102 of the first roller pair located upstream is divided into a plurality of (four) small rollers along the rotational axial direction (the vertical direction on the paper of FIG. 3) of the pinch roller 102. The respective small rollers can be driven to rotate independently of one another. The pinch roller 102 is divided into the plurality of rollers for the following reason. Since the first roller pair located upstream controls the conveyance, the first roller pair is more strictly required to support a sheet with a nip pressure unchanged throughout the whole area of the sheet in the sheet width direction than the second roller pair.

If the pinch roller 102 is constituted by a single roller body without being divided, even a slight inclination of the rotational axis, if any, results in an uneven distribution of the nip pressure applied to a sheet. This uneven distribution may cause a deviation of the sheet traveling direction from the originally set direction, i.e., a so-called skew state. Dividing the pinch roller 102 into a plurality of rollers allows the divided rollers to independently apply a nip pressure, thereby reducing the possibility that the nip pressure may be unevenly applied in the sheet width direction.

Further, a pinch roller constituted by a single body is subject to a deflection, and tends to intensively apply nip pressures at the respective edges of a sheet, whereby a difference is generated between the nip pressures at the respective edges to thereby destabilize force application to the sheet, facilitating generation of, for example, wrinkles, slacks, and a skew state of the sheet. The printing apparatus according to the present exemplary embodiment can use various sizes of sheets. Use of different sizes of sheets in the sheet width direction may cause the rollers located at the ends, among the plurality of divided rollers constituting the pinch roller 102 included in the first roller pair, to be put in the following three states in the rotational axial direction of the rollers: (1) a state that the roller is in contact with a sheet throughout the whole length of the roller; (2) a state that the roller is in contact with a sheet at only a part of the length of the roller; and (3) a state that the roller is totally out of contact with a sheet. It should be noted that the term "whole length" and "a part of length" here are used to mean the whole or a part of a generally linear narrow area at which a rotating roller contacts a sheet, but not to mean the whole surface of a roller throughout the entire circumference of the roller.

Figure 4A:
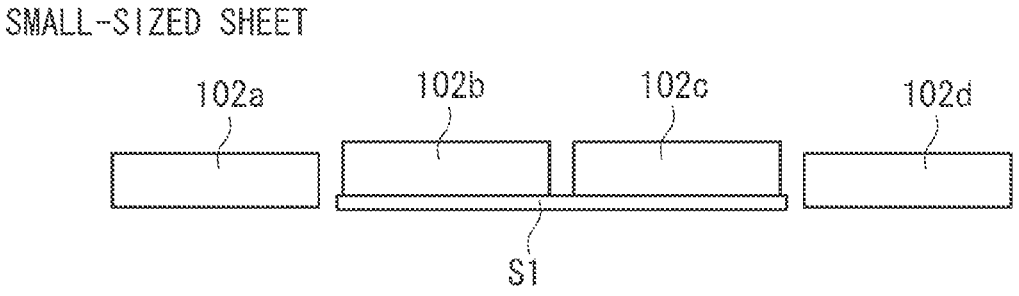
FIGS. 4A, 4B, and 4C schematically illustrate postural changes of pinch rollers when they are applied to sheets different in size.
Figure 4B:
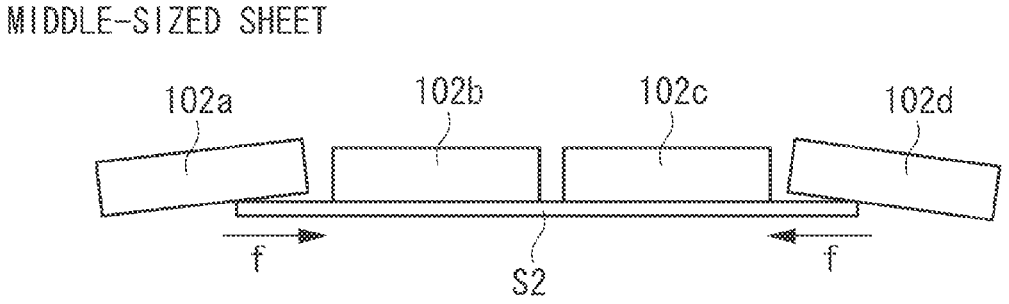
Figure 4C:
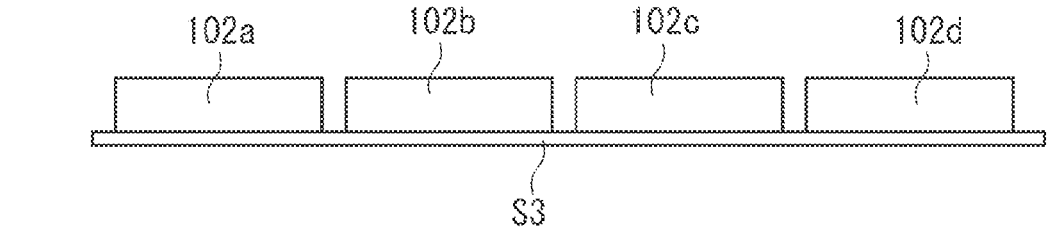

FIGS. 4A, 4B, and 4C schematically illustrate what the pinch rollers are like in the states (1) to (3), and indicate postural changes of the pinch rollers when they are applied to different sizes of sheets. In particular, FIGS. 4A, 4B, and 4C illustrate the states (3), (2), and (1), respectively. The pinch roller 102 is divided into four rollers 102*a*, 102*b*, 102*c*, and 102*d* in this order from one end to the other end. A sheet is conveyed in the vertical direction on the paper of FIGS. 4A, 4B, and 4C during a printing operation. A sheet is supplied by the method of causing the center of the sheet to pass through a same position in the sheet width direction regardless of the size of the sheet, i.e., the so-called center alignment method. In the examples illustrated in FIGS. 4A, 4B, and 4C, a sheet, no matter which size the sheet has, is conveyed in such a manner that the center of the sheet passes through the middle position between the roller 102*b* and 102*c*.

As will be used herein, the term "first roller portion" is used to refer to the outer rollers 102*a* and 102*d* farther away from the center of a sheet in the rotational axial direction, while the term "second roller portion" is used to refer to the inner rollers 102*b* and 102*c* located adjacent to the first roller portion and closer to the center of the sheet.

FIG. 4A illustrates what the rollers 102*a* to 102*d* are like when the printing apparatus uses a sheet S1 having a minimum size among sizes of sheets that are expected to be used as a recording medium. The sheet S1 has a sheet width approximately equal to the sum of the lengths of the inner two rollers 102*b* and 102*c*, and the outer rollers 102*a* and 102*d* adjacent thereto are out of contact with the sheet S1. Therefore, both the outer rollers 102*a* and 102*d* are postured like the state (3). FIG. 4B illustrates what the pinch rollers 102*a* to 102 are like when the printing apparatus uses a sheet S2 having a sheet width of a middle size larger than the minimum size of the sheet S1 but smaller than a maximum size, among sheets that are expected to be used as a recording medium. The sheet S2 has a sheet width wider than the sum of the lengths of the inner two rollers 102*b* and 102*c*, so that the outer rollers 102*a* and 102*d* are located in such a manner that the inner side of each of them is partially in contact with the sheet S2 while the remaining outer side thereof is partially out of contact with the sheet S2. Therefore, both the outer rollers 102*a* and 102*d* are postured like the state (2). FIG. 4C illustrates what the pinch rollers 102*a* to 102*d* are like when the printing apparatus uses a sheet S3 having the maximum size among sizes of sheets that are expected to be used as a recording medium. The sheet S3 has a sheet width approximately equal to or wider than the sum of all of the lengths of the four rollers 102*a* to 102*d*, so that the whole lengths of the outer rollers 102*a* and 102*d* are in contact with the sheet S3. Therefore, in this case, both the outer rollers 102*a* and 102*d* are postured like the state (1).

In the state (1) or (3), the outer rollers 102*a* and 102*d* rotate while keeping the same postures as the inner rollers 102*b* and 102*c* without being inclined. On the other hand, in the state (2), since the outer rollers 102*a* and 102*d* are partially in contact with the sheet S2, slight postural changes are made at the rollers 102*a* and 102*d*, leading to inclinations of the rollers 102*a* and 102 (refer to FIG. 4B). Therefore, comparing the state (1) and the state (2), the outer rollers 102*a* and 102*d* apply forces to the sheet in different directions and with different strengths. The inner rollers 102*b* and 102*c* have unchanged postures in any of the states (1) to (3).

In the state (2), the inclinations of the rollers 102*a* and 102*d* occur mainly in two directions. A first roller inclination occurs in such a manner that a portion of the roller rides on an edge of a sheet and is lifted up in the diametrical direction of the roller, thereby generating the inclination. FIG. 4B illustrates this inclination. The occurrence of the first inclination causes the roller to apply a force for moving the sheet from the outer side to the inner side to the edge of the sheet in the sheet width direction. More specifically, as illustrated in FIG. 4B, the respective edges of the sheet S2 receive the forces f in the direction indicated by the arrows toward the inner side of the sheet S2 from the rollers 102*a* and 102*d* in contact with them. Therefore, the edges of the sheet S2 may be moved inward, and a part of the sheet may be lifted up to generate wrinkles and corrugations. The force f is a component force of the nip pressure between the roller and the sheet, so that an increase in the nip pressure results in an increase in the force f, thereby further facilitating generation of wrinkles and corrugations.

Figure 5:
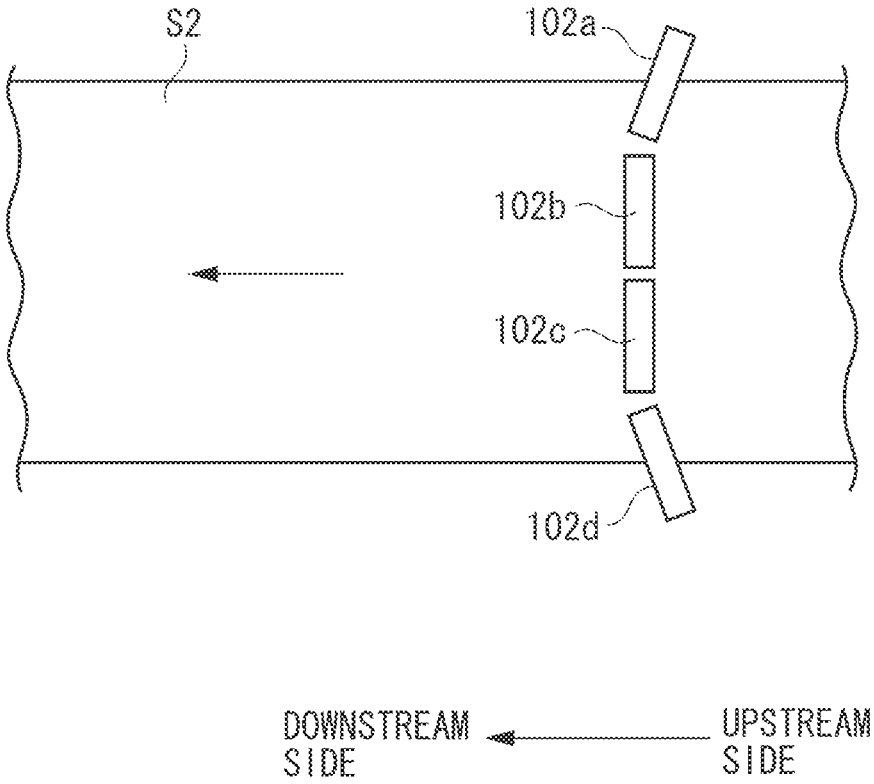
FIG. 5 schematically illustrates inclinations of the pinch rollers in terms of another component.

A second roller inclination occurs in the sheet conveyance direction. This inclination occurs as if a part of the roller in contact with a sheet is pulled by the moving sheet from the downstream side. FIG. 5 illustrates this inclination. As mentioned above, since the first roller pair located upstream operates at a slower roller circumferential speed (conveyance speed) than the second roller pair located downstream, the sheet S2 is put in a state pulled from the downstream side at the position of the pinch roller 102. Therefore, the inner rollers 102*b* and 102*c* are slightly displaced toward the downstream side by being pulled by the sheet S2. However, this displacement does not cause a change in the orientation of the rotational axis thereof. On the other hand, the outer rollers 102*a* and 102*d* are pulled at only the portions thereof in contact with the sheet S2 from the downstream side, and this causes the rotational axes thereof to be obliquely inclined relative to the originally set direction. This is the second roller inclination. When the outer rollers 102*a* and 102*d* are inclined in this way, the portions of the sheet in contact with the rollers 102*a* and 102*d* are locally contorted, which may also lead to generation of wrinkles. Further, the first inclination and the second inclination may cause a deviation of the sheet traveling direction from the originally set direction, i.e., a skew state.

Generation of wrinkles and corrugations at a sheet, or generation of a skew state of a sheet during sheet conveyance leads to a deterioration of the quality of the image printed on the sheet. In view of this technical problem, the present exemplary embodiment provides a solution enabling sheet conveyance at high accuracy, no matter which sheet the printing apparatus uses. The present exemplary embodiment changes the difference or the ratio between the pressing force that the first roller portion applies to the conveyance roller 101 and the pressing force that the second roller portion applies to the conveyance roller 101 via the adjustment mechanism 110 according to a sheet that the printing apparatus uses. The concrete structure and operation for carrying out this operation now be described.

Figure 6:
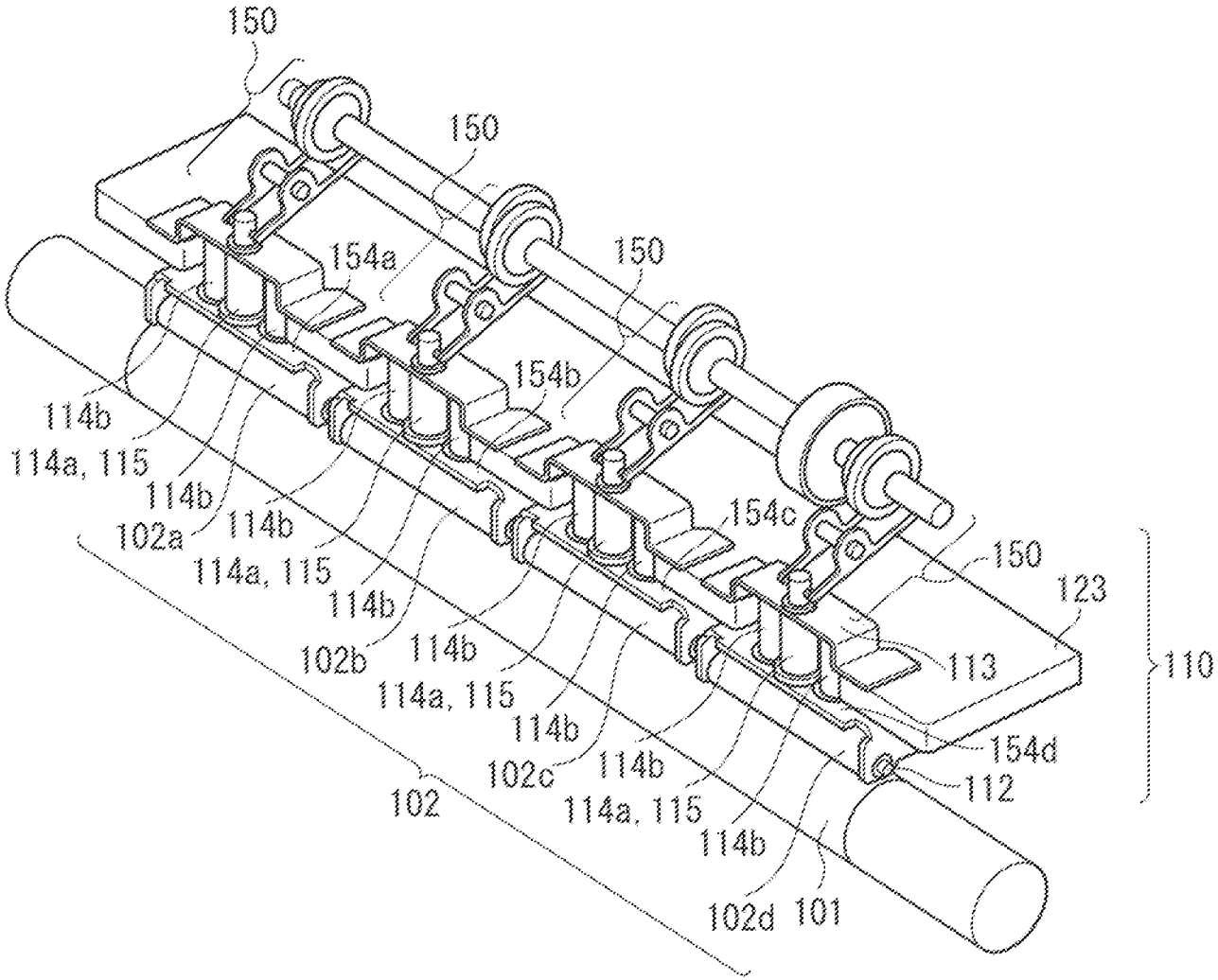
FIG. 6 is a perspective view illustrating structural details of an adjustment mechanism for nip pressures of the pinch rollers according to the exemplary embodiment of the present invention.

FIG. 6 is a perspective view illustrating the structural details of the first roller pair. The nip pressures between the respective four rollers 102*a* to 102*d*, which constitute the pinch roller 102, and the conveyance roller 101 are individually adjusted by the adjustment mechanism 110 disposed above these roller pairs. The structure of the adjustment mechanism 110 will now be described.

The four rollers 102*a* to 102*d* are held by four holders 154*a* to 154*d* respectively corresponding to the rollers 102*a* to 102*d*, and are arranged to be rotatable around a rotational shaft 112. Four plate members 113 are fixed to a common reference fixation portion 123 so as to respectively face the holders 154*a* to 154*d*. A rod 115 and springs, serving as elastic members, are disposed between each of the holders 154*a* to 154*d* and the corresponding plate member 113. The springs are constituted by three springs in total, a primary spring 114*a* disposed around the rod 115 as a helicoidal spring, and auxiliary springs (two springs) disposed at the both sides of the primary spring 114*a*. The three springs are arranged along the axial direction of the rotational shaft 112.

Cam mechanisms 150 are disposed at four positions as driving mechanisms for vertically moving the holders 154*a* to 154*d*, respectively. The cam mechanisms 150 each include a cam and a cam lever, and convert a displacement of the cam into a vertical movement of the cam lever. The rods 115 each have one end fixed to the tip of the cam lever, and the other end fixedly inserted through a hole formed at the holder 154*a*, 154*b*, 154*c*, or 154*d* so as to be prevented from being pulled out therefrom. The primary springs 114*a* each are compressed between the cam lever and the holder 154*a*, 154*b*, 154*c*, or 154*d* while being supported by the rod 115. Further, the auxiliary springs 114*b* each have one end fixed to the back surface of the plate member 113, and the other end fixed to the top surface of the holder 154*a*, 154*b*, 154*c*, or 154*d*, thereby being compressed there between. Since the auxiliary springs 114*b* are symmetrically disposed at the both sides of the primary spring 114*a*, even when the roller 102*a*, 102*b*, 102*c*, or 102*d* is about to be inclined, the auxiliary springs 114*b* can apply a force for preventing the inclination.

Vertically moving the cam levers by the cam mechanisms 150 causes vertical movements of the respective holders 154*a* to 154*d* through the rods 115. Each of the nip pressures of the rollers 102*a* to 102*d* is individually adjusted according to the position of the cam lever in the vertical movement direction and the sum of the spring pressures of the three springs 114*a* and 114*b* interposed in a compressed state.

Figure 7A:
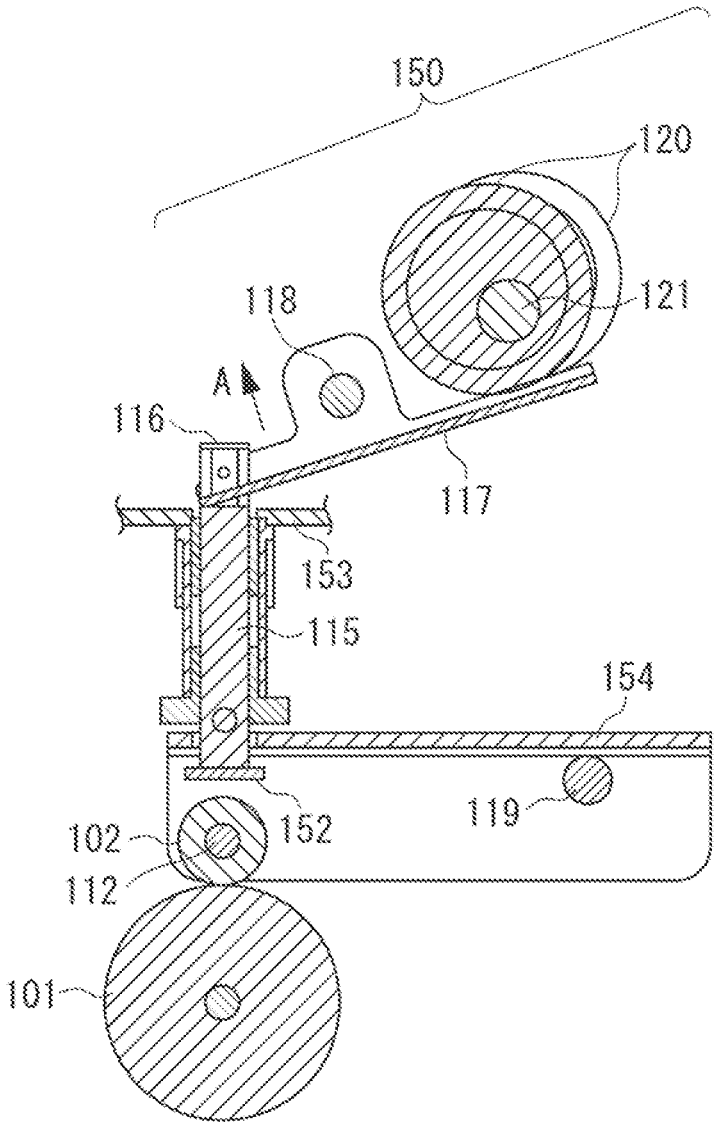
FIGS. 7A and 7B are cross-sectional views illustrating a structure of a cam mechanism included in the adjustment mechanism according to the exemplary embodiment of the present invention.
Figure 7B:
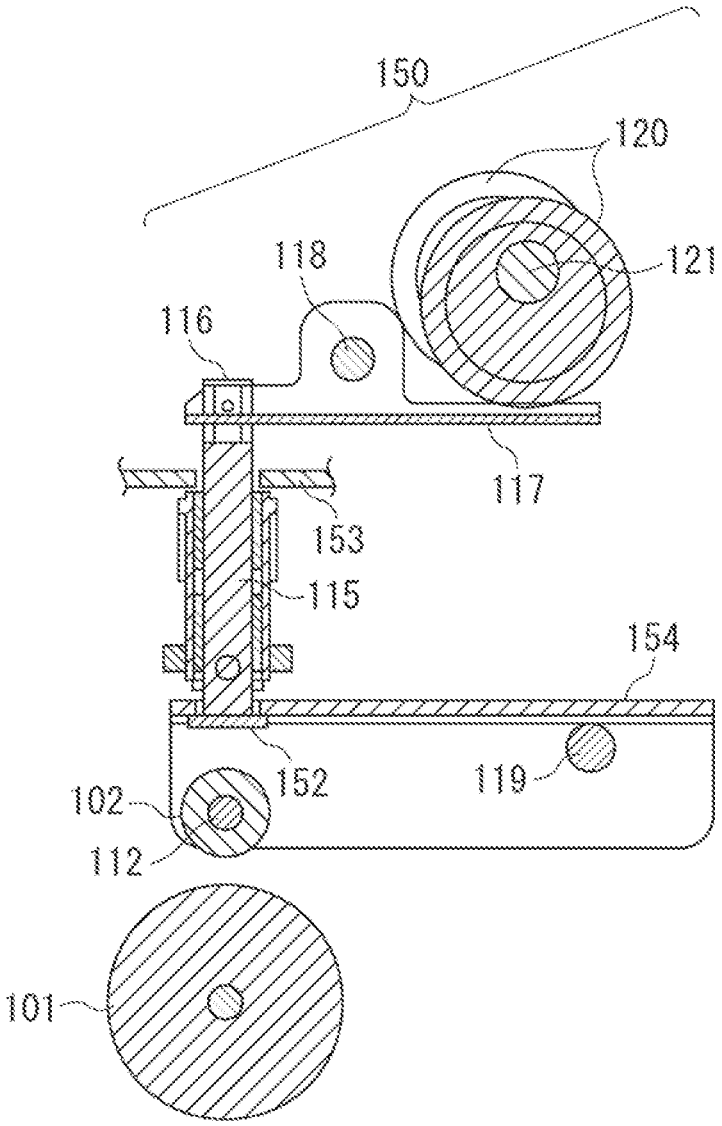

FIGS. 7A and 7B are cross-sectional views illustrating the structure of one of the four cam mechanisms 150. FIG. 7A illustrates a nip state in which the rod 115 is pressed down, while FIG. 7B illustrates a release state in which the rod 115 is lifted up. The cam 120 is fixed eccentrically relative to a rotating cam shaft 121. A common single shaft is prepared as the cam shaft 121 for the cams 120 disposed at the four positions. The cam lever 117 is supported rotatably around a pivot 118. One end of the cam lever 117 is in abutment with the surface of the cam 120. The upper end of the rod 115 is rotatably fixed to the tip of the other end of the cam lever 117 by a pin 116. The upper end side of the rod 115 extends through the hole formed at the plate member 113, and is supported by the hole so as to prevent the position of the rod 115 from being displaced. The lower end side of the rod 115 extends through the hole formed at the holder 154, and is supported by the hole so as to prevent the position of the rod 115 from being displaced. A clasp 152, which is larger in diameter than the hole, is provided at the lower end of the rod 115. The clasp 152 prevents the rod 115 from being pulled out from the hole of the holder 154. The holder 154 is fixed rotatably around a pivot 119. The pinch roller 102 is held rotatably around the rotational shaft 112 which is pivotally supported at two positions on the side surfaces of the holders 154.

In this structure, a rotation of the cam shaft 121 changes the phase of the cam 120, thereby changing the height of the cam lever 117. According thereto, the rod 115 is vertically moved, and thereby the holder 154 is vertically moved as well. As a result, the height of the pinch roller 102 is changed relative to the conveyance roller 101 having a fixed height, thereby allowing switching between the nip state and the release state. There is a difference between the phase of the cams 120 corresponding to the pinch rollers 102*a* and 102*d*, and the phase of the cams 120 corresponding to the pinch rollers 102*b* and 102*c*. Therefore, a rotation of the cam shaft 121 results in different vertical movements according to the pinch rollers.

The control unit 13 issues an instruction to drive the cam mechanisms 150 to change the distances of pressing the respective holders 154*a* to 154*d* via the primary springs 114*a* and the auxiliary springs 114*b*, which are elastic members, thereby determining the nip pressures. The pressing forces (nip pressures) with which the respective rollers 102*a* to 102*d* press the conveyance roller 101 can be changed according to the amounts of pressing the rods 115 (positions of the cam levers 117) by the cam mechanisms 150. FIG. 8 illustrates an example of this setting. In this example, forces of 1000 gf, 1500 gf, 1500 gf, and 1000 gf are applied to the four rollers 102*a* to 102*d* in this order, respectively. The total force of a biasing force (a) of the primary spring 114*a* and biasing forces (2*c*) of the two auxiliary springs 114*b*, i.e., a force of (a+2*c*) is applied to the each of the rollers 102*a* and 102*d* which constitute the first roller portion. For example, if (a) is 600 gf and (c) is 200 gf, the total pressure is 1000 gf. The total force of a biasing force (b) of the primary spring 114*a* and biasing forces (2*d*) of the two auxiliary springs 114*b*, i.e., a force of (b+2*d*) is applied to each of the rollers 102*b* and 102*c* which constitute the second roller portion. For example, if (b) is 500 gf and (d) is 500 gf, the total pressure is 1500 gf. As the whole pinch roller 102, the total of these four forces is applied to the conveyance roller 101 as the nip pressure. In this example, the total pressure is 5000 gf.

The printing apparatus according to the present exemplary embodiment switches the nip pressure to a suitable one to the condition (for example, the size and sheet stiffness) of a sheet that the printing apparatus uses. FIG. 9 illustrates five examples (example 1 to example 5) about the set values of the nip pressures. The control unit 13 controls a motor, which is prepared for rotating the cam shaft 121, to rotate and stop at a predetermined position, whereby it is possible to acquire a desired pressure among the five examples 1 to 5.

The example 1 is the setting suitable to a sheet having a large size in the sheet width direction, and relatively high sheet stiffness. The term "large size" here means a size causing the outer two rollers 102*a* and 102*d* to be in contact with the both edges of the sheet throughout the whole lengths of the rollers 102*a* and 102*d*, as illustrate in FIG. 4C. In this example, the adjustment mechanism 110 is set in such a manner that the uniform and equal forces, 1500 gf, 1500 gf, 1500 gf, and 1500 gf are applied to the four rollers 102*a* to 102*d* in this order, respectively. The total pressure of the nip pressures is 6000 gf. Increasing the nip pressures reduces a slip between the sheet surface and the roller surface, thereby realizing sheet conveyance at further higher accuracy. When a sheet to be used has sufficiently high sheet stiffness, even increasing the nip pressures generates only a slight deformation, so that the maximum pressure forces are provided to all four of the four pinch rollers 102*a* to 102*d* in the example 1. All of the four rollers 102*a* to 102*d* evenly contact the sheet throughout the entire length of the rollers 102*a* to 102*d* in the rotational axial direction of the rollers 102*a* to 102*d*, so that the same force is set as the four pressing forces.

The example 2 is the setting suitable to a sheet having a middle size in the sheet width direction, and relatively high sheet stiffness. The term "middle size" means a size causing the outer two rollers 102*a* and 102*d* to be only partially in contact with the both edges of the sheet, as illustrated in FIG. 4B. The adjustment mechanism 110 is set in such a manner that different forces, 1000 gf, 1500 gf, 1500 gf, and 1000 gf are applied to the four rollers 102*a* to 102*d* in this order, respectively. In this example, the total pressure of the nip pressures is 5000 gf, and is the same as the example indicated in FIG. 8. As described above, the outer two rollers 102*a* and 102*d* only partially contact the sheet, whereby the rollers 102*a* and 102 are inclined, as a result of which wrinkles and corrugations may be formed on the sheet or the sheet may be skewed while being conveyed. As the nip pressures are higher, the generation of wrinkles and corrugations increases. As illustrated in FIG. 4B, since the force f is a component force of the nip pressure between the roller and the sheet, a higher nip pressure leads to a stronger force f. Therefore, the example 2 sets weaker forces as the pressing forces of the outer two rollers 102*a* and 102*d* than those in the example 1. For the two rollers 102*b* and 102*c*, the same maximum pressing forces as the example 1 are set according to the degree of sheet stiffness so as to reduce a slip as much as possible. In this way, the difference or the ratio between the respective pressing forces of the first roller portion and the second roller portion is changed by the adjustment mechanism 110 between the examples 1 and 2. In other words, comparing the state 1 in which the first roller portion nips a sheet with the entire length thereof, and the second state in which the first roller portion nips the sheet with a part of the length thereof, the adjustment mechanism 110 is set so as to reduce the pressing force of the first roller portion in the state 2 compared to the pressing force in the state 1.

The example 2 is also the setting suitable to a sheet having a large size in the sheet width direction and relatively low sheet stiffness. Assume that the sheet size in this example is such a size that the both edges of the sheet extend further beyond the outer rollers 102*a* and 102*d*. If the sheet stiffness is lower than the example 1, the maximum nip pressures of the rollers 102*a* and 102*d* may cause the portions of the sheet extending beyond the rollers 102*a* and 102*d* to curve upwards. These portions, if they are large, may contact the print head 14. The example 2 sets the nip pressures of the outer rollers 102*a* and 102*d* to be lower than the inner rollers 102*b* and 102*c*, which is effective to prevent the edges of the sheet, which the rollers 102*a* and 102*d* cannot hold, from curving up.

The example 3 is the setting suitable to a sheet having a middle size in the sheet width direction and relatively low sheet stiffness. The adjustment mechanism 110 is set so that different forces, 200 gf, 1000 gf, 1000 gf, and 200 gf are applied to the four rollers 102*a* to 102*d* in this order. The total pressure of the nip pressures is 2400 gf. Since the sheet in the example 3 has lower sheet stiffness than the sheet in the example 2, although the sheet size is the same middle size, the total nip pressure is reduced compared to the example 2 to prevent the nip pressure from deforming the sheet. Different pressing forces are set for the inner rollers 102*b* and 102*c*, and the outer rollers 102*a* and 102*d* of the pinch roller 102, thereby preventing generation of wrinkles and corrugations at the sheet, and occurrence of a skew state of the sheet.

The example 4 is the setting suitable to a sheet having a small size in the sheet width direction. The term "small size" means such a size that the outer two rollers 102*a* and 102*d* are completely out of contact with the sheet, as illustrated in FIG. 4A. The adjustment mechanism 110 is set so that a release, a force of 1500 gf, a force of 1500 gf, and a release are applied to the four rollers 102*a* to 102*d* in this order, respectively. The total pressure of the nip pressures is 3000 gf. Since the sheet is conveyed by the inner two rollers 102*b* and 102*c*, a desired effect can be acquired by setting values suitable to the sheet stiffness as the pressing forces of these rollers. In this example, the maximum pressing forces are applied, assuming that the sheet has high sheet stiffness. Since the outer two rollers 102*a* and 102*d* do not involve the sheet conveyance at this time, any pressing force can be set thereto. In this example, the rollers 102*a* and 102*d* are released with the pressing forces thereof set to zero.

The example 5 is the setting suitable at the time of rewinding of a sheet after a printing operation, or at the time of maintenance in response to occurrence of a sheet conveyance jam. All of the four rollers 102*a* to 102*d* are set so as to be floated from the conveyance roller 101 in a release state. All of the forces applied to the four rollers 102*a* to 102*d* are 0 gf. In other words, the total pressure of the nip pressures is 0 gf.

Figure 10:
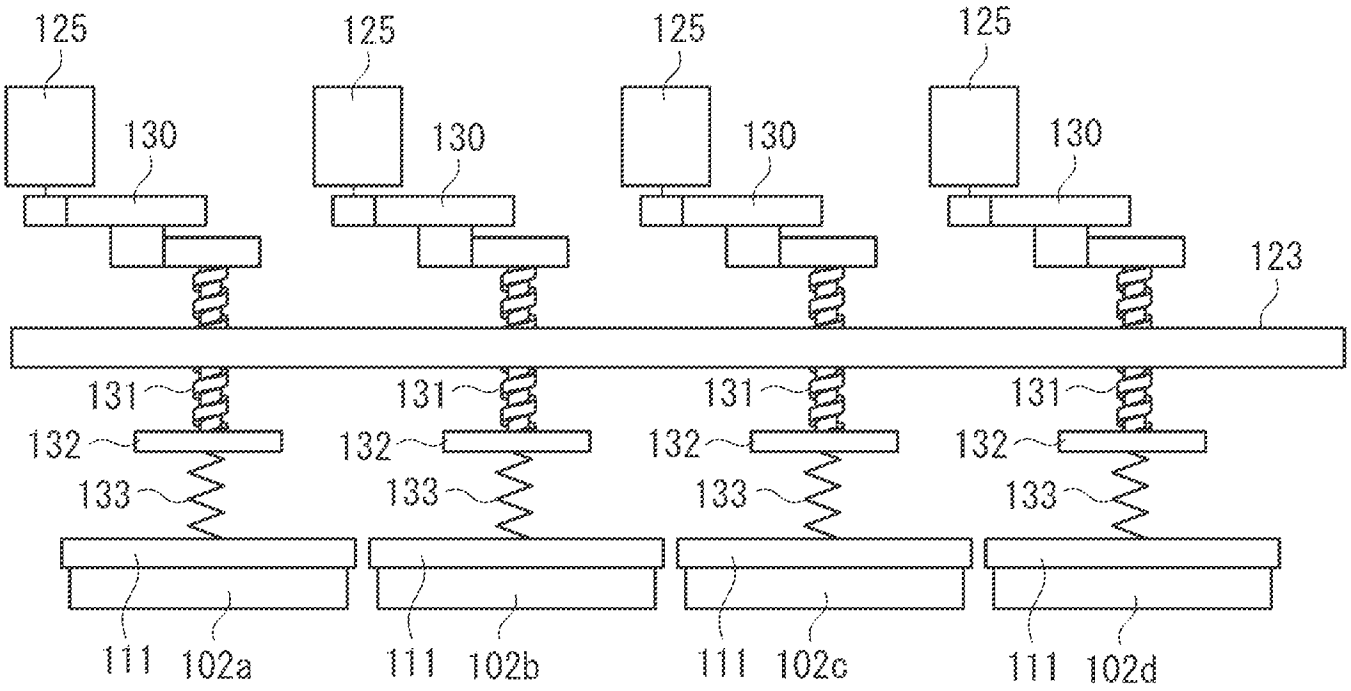
FIG. 10 is a cross-sectional view of a structure of an adjustment mechanism according to another exemplary embodiment of the present invention.

FIG. 10 is a cross-sectional view illustrating the structure of an adjustment mechanism according to another exemplary embodiment of the present invention. In the present exemplary embodiment, the adjustment mechanism is configured using a lead screw, instead of the above-described cam mechanism. A rotational driving force of a motor 125 is transmitted to a lead screw 131 supported by the reference fixation unit 123 via a gear array 130. The four divided rollers 102*a* to 102*d*, which constitute the pinch roller 102, are rotatably supported by holders 111, respectively. A spring 133 is disposed between a spring stopper 132 and the holder 111 in a compressed state. In this structure, a rotation of the motor 125 causes a rotation of the lead screw 131, and this rotation is converted into a vertical movement of the spring stopper 132. The vertical movement of the spring stopper 132 allows the nip pressure of the roller 102*a*, 102*b*, 102*c*, or 102*d* to be individually changed via the spring 133.

The above-described exemplary embodiments individually adjust the nip pressures according to a condition of a sheet that the printing apparatus uses, such as a sheet size and sheet stiffness. However, the nip pressures may be adjusted according to another condition of a sheet. For example, when the printing apparatus continuously prints data on both surfaces of a sheet as described above, at least one of the first roller portion and the second roller portion may apply different pressing forces to the conveyance roller 101 between printing on a first surface and printing on a second surface. Sometimes, the printing apparatus may have to print data under different sheet conditions between printing on a first surface and printing on a second surface. For example, a sheet with data printed on the first surface thereof is swollen by absorbing ink, and therefore the sheet stiffness of the sheet may be reduced at the time of printing on the second surface compared to the time of printing on the first surface. In this case, the adjustment mechanism 110 can be set in such a manner that the first roller portion and the second roller portion apply reduced nip pressures at the time of printing on the second surface compared to the time of printing on the first surface. Further, a sheet with an image printed on the first surface thereof may have a changed friction coefficient by absorbing ink. In this case, the nip pressures can be changed between printing on the first surface and printing on the second surface in consideration of the possibility of a slip. As a result, the printing apparatus can operate during printing on the first surface and printing on the second surface for two-sided printing under a same unchanged sheet conveyance condition, so that it is possible to reduce a positional misalignment between images printed on the front surface and the back surface of the sheet.

As described above, the exemplary embodiments of the present invention include the pinch roller 102 divided into a plurality of rollers including the first roller portion and the second roller portion adjacent to each other. Further, the exemplary embodiments include the adjustment mechanism 110 capable of changing the difference or ratio between the respective pressing forces which the first roller portion and the second roller portion apply to the conveyance roller 101. The pressing force of the first roller portion is changed according to the size of a sheet, which the printing apparatus uses, in the sheet width direction. Further, as a sheet to be used has lower sheet stiffness, the exemplary embodiments set the pressing force of the first roller portion to a weaker force. As a result, the exemplary embodiments can realize a sheet conveying apparatus and a printing apparatus capable of conveying a sheet at high accuracy regardless of a sheet that the printing apparatus uses.

As illustrated in FIG. 3, in the printing unit 4, the relationship between the first roller pair and the second roller pair is such that the second roller pair has a higher circumferential speed of the roller outer circumference (the speed for conveying a sheet) and a lower total nip pressure than those of the first roller pair. In this system, the first roller pair has a greater influence on sheet conveyance (conveyance speed and conveyance accuracy) than the second roller pair. Therefore, the nip roller of the first roller pair, which can be expected to bring a more significant effect than the second roller pair, is divided into a plurality of rollers, and the nip pressures thereof are individually adjusted according to a sheet that the printing apparatus uses. As a result, it is possible to realize a printing apparatus capable of conveying a sheet at higher accuracy and thereby acquiring an excellent print quality.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-028715 filed Feb. 14, 2011, which is hereby incorporated by reference herein in its entirety.

What is claimed is:

1. A sheet conveying apparatus comprising:

a conveyance roller;

a pinch roller unit configured to nip a sheet with the conveyance roller, wherein the pinch roller unit includes a first roller portion and a second roller portion adjacent to each other, and the first roller portion is disposed farther away from a center of the sheet in a width direction of the sheet than the second roller portion; and a mechanism having a drive source configured to change a pressing force that the first roller portion applies to the conveyance roller and a pressing force that the second roller portion applies to the conveyance roller, respectively, wherein, in a first case where a sheet to be used has a medium size in the width direction such that an end of the sheet is nipped by a part of the first roller portion and the sheet is nipped by an entire extent of the second pressing roller, the mechanism sets a pressing force of the first roller portion smaller than a pressing force of the second pressing roller portion, wherein in a second case where a sheet to be used has a large size in the width direction such that the sheet is nipped by an entire extent of the first roller portion and an entire extent of the second roller portion, the mechanism sets a pressing force of the first roller portion and a pressing force of the second roller portion equal to each other, and wherein in a third case where a sheet to be used has a small size in the width direction such that the sheet is not nipped by the first roller portion, the mechanism sets a pressing force of the first roller portion smaller than that in the first case.

2. The sheet conveying apparatus according to claim 1, wherein in the third case, the mechanism release a nip of the first roller portion.

3. The sheet conveying apparatus according to claim 1, wherein the pressing force of the first roller portion and the pressing force of the second roller portion are made weaker as the sheet to be used has lower sheet stiffness.

4. The sheet conveying apparatus according to claim 1, wherein the first roller portion is held by a first holder and the second roller portion is held by a second holder, and wherein the mechanism is configured to apply a variable pressing force to the first holder and the second holder via an elastic member in a direction such that the first holder and the second holder are moved closer to the conveyance roller.

5. The sheet conveying apparatus according to claim 4, wherein the mechanism includes a lever rotatable by a cam mechanism, a rod connecting the lever and the first holder or the second holder, and the elastic member is configured to apply a biasing force to the first holder or the second holder, and wherein the pressing force is changed by driving the cam mechanism.

6. A printing apparatus comprising:

a print head;

a first conveying unit disposed upstream of the print head in a sheet conveyance direction during printing, the first conveying unit including a first roller pair configured to convey a sheet while nipping the sheet; and a second conveying unit disposed downstream of the print head in the sheet conveyance direction, the second conveying unit including a second roller pair configured to convey the sheet while nipping the sheet, wherein a conveyance force that the first roller pair conveys the sheet is greater than the conveyance force the second roller pair conveys the sheet, wherein the first roller pair includes:

a conveyance roller;

a pinch roller unit configured to nip the sheet with the conveyance roller, wherein the pinch roller unit includes a first roller portion and a second roller portion adjacent to each other, and the first roller portion is disposed farther away from a center of the sheet in a width direction of the sheet than the second roller portion; and a mechanism having a driving source configured to change a pressing force that the first roller portion applies to the conveyance roller and a pressing force that the second roller portion applies to the conveyance roller, respectively, wherein, in a first case where a sheet to be used has a middle size in the width direction such that an end of the sheet is nipped by a part of the first roller portion and the sheet is nipped by an entire extent of the second pressing roller, the mechanism sets a pressing force of the first roller portion smaller than a pressing force of the second pressing roller portion, wherein in a second case where a sheet to be used has a large size in the width direction such that the sheet is nipped by an entire extent of the first roller portion and an entire extent of the second roller portion, the mechanism sets a pressing force of the first roller portion and a pressing force of the second roller portion equal to each other, and wherein in a third case where a sheet to be used has a small size in the width direction such that the sheet is not nipped by the first roller portion, the mechanism sets a pressing force of the first roller portion smaller than that in the first case.

7. The printing apparatus according to claim 6, wherein the second roller pair has a higher roller circumferential speed and a lower total nip pressure than those of the first roller pair.

8. The printing apparatus according to claim 6, wherein the printing apparatus sequentially prints, via the print head, a plurality of images on a first surface of a continuous sheet, and subsequently sequentially prints a plurality of images on a second surface of the sheet, wherein the second surface is disposed on a side of the continuous sheet opposite to the side of the first surface, and wherein at least one of the first roller portion and the second roller portion applies a different pressing force to the conveyance roller between printing on the first surface and printing on the second surface.

9. The printing apparatus according to claim 6, wherein the print head includes a line print head of an inkjet printing system.

10. The printing apparatus according to claim 6, wherein in the third case, the mechanism release a nip of the first roller portion.

* * * * *